US008627880B2

(12) United States Patent
Dittmann et al.

(10) Patent No.: US 8,627,880 B2
(45) Date of Patent: Jan. 14, 2014

(54) EXHAUST GAS COOLER

(75) Inventors: Jörg Dittmann, Stuttgart (DE); Holger Peters, Vaihingen/Enz (DE); Harald Rieger, Stuttgart (DE); Bernhard Schwalk, Ludwigsburg (DE)

(73) Assignee: Mahle International GmbH (DE)

( * ) Notice: Subject to any disclaimer, the term of this patent is extended or adjusted under 35 U.S.C. 154(b) by 936 days.

(21) Appl. No.: 12/642,068

(22) Filed: Dec. 18, 2009

(65) Prior Publication Data

US 2010/0162699 A1 Jul. 1, 2010

(30) Foreign Application Priority Data

Dec. 19, 2008 (DE) ..... 10 2008 064 090

(51) Int. Cl.

| | |
|---|---|
| ***F28F 13/12*** | (2006.01) |
| ***F28D 1/053*** | (2006.01) |
| ***F28F 9/04*** | (2006.01) |
| ***F28F 1/42*** | (2006.01) |

(52) U.S. Cl.

USPC ..... 165/109.1; 165/148; 165/158; 165/170; 165/177; 165/179

(58) Field of Classification Search

USPC ..... 165/109.1, 148, 17, 177, 179, 170, 158

See application file for complete search history.

(56) References Cited

U.S. PATENT DOCUMENTS 2,017,201 A * 10/1935 Bossart et al. ..... 165/177
4,932,469 A * 6/1990 Beatenbough ..... 165/170

(Continued)

FOREIGN PATENT DOCUMENTS

| | | | |
|---|---|---|---|
| EP | 2071263 | A1 | 6/2009 |
| EP | 2199722 | A2 | 6/2010 |
| WO | WO-2007082774 | A2 | 7/2007 |
| WO | WO-2008041195 | A2 | 4/2008 |

OTHER PUBLICATIONS

English abstract for EP-2071263.

*Primary Examiner* — Leonard R Leo

(74) *Attorney, Agent, or Firm* — Rader, Fishman & Grauer PLLC

(57) ABSTRACT

The present invention relates to an exhaust gas cooler (1), in particular for an exhaust gas recirculation system of an internal combustion engine, preferably of a motor vehicle, comprising an exhaust gas inlet (2) which is connected in a communicating manner with an inlet chamber (4), an exhaust gas outlet (3) which is connected in a communicating manner with an outlet chamber (5), a plurality of exhaust gas pipes (7) which are configured as flat pipes, extend parallel to each other through a coolant chamber (8) and are connected in a communicating manner on one side to the inlet chamber (4) and on the other side to the outlet chamber (5), a coolant inlet (9) which is connected in a communicating manner to the coolant chamber (8), and a coolant outlet (10) which is connected in a communicating manner to the coolant chamber (8). The exhaust gas pipes (7) have on mutually opposite sides (28) a plurality of outwardly projecting protrusions (29) which are spaced apart from each other in the longitudinal direction (30) of the exhaust gas pipes (7).

Figures 1, 2:
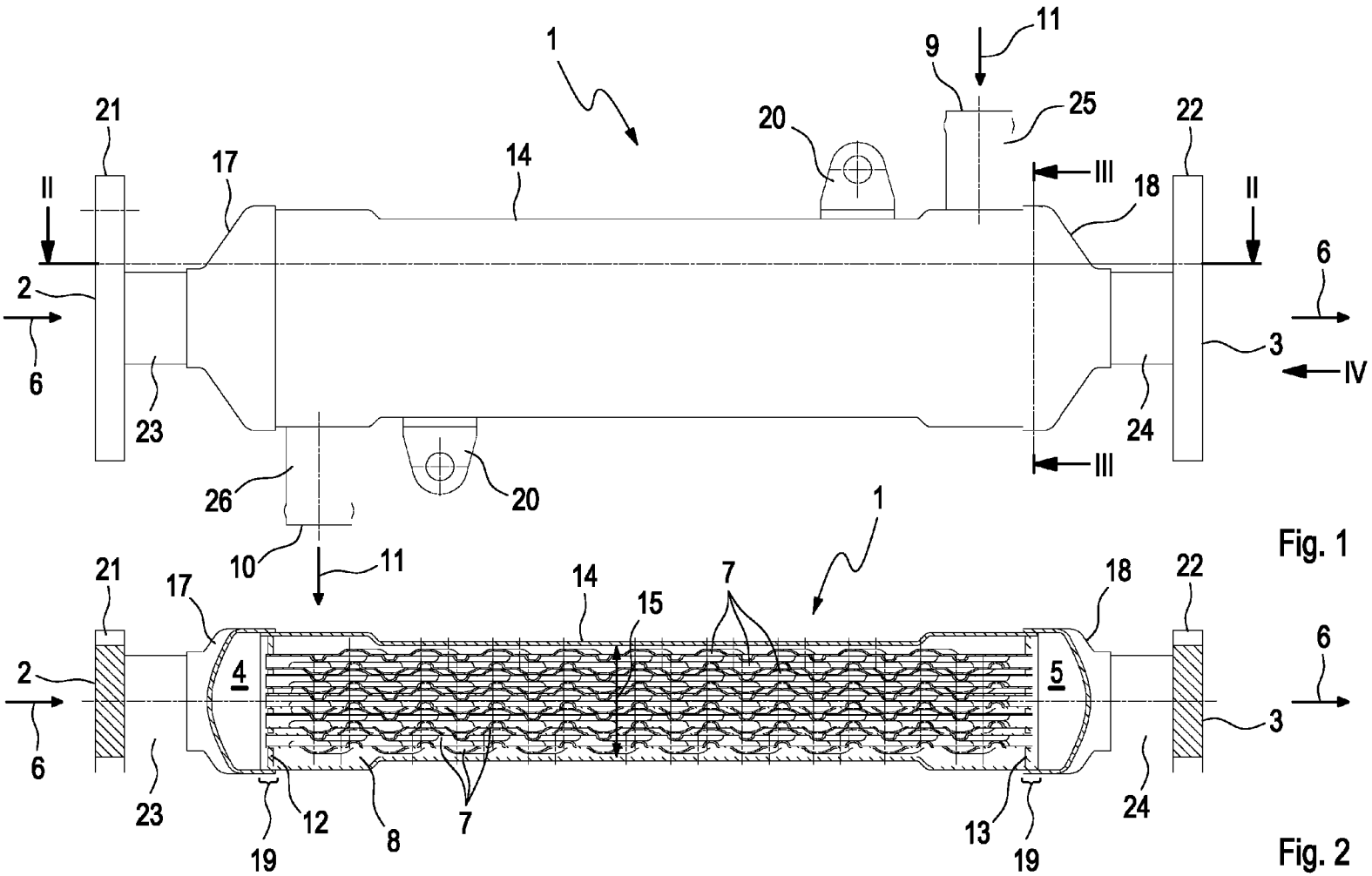

A simplified cooling effect can be achieved if, with in each case two adjacent exhaust gas pipes (7), the protrusions (29) of one exhaust gas pipe (7) bear in each case directly against the other exhaust gas pipe (7) at a distance in the longitudinal direction (30) of the exhaust gas pipes (7) from the nearest protrusion (29) of the other exhaust gas pipe (7).

22 Claims, 6 Drawing Sheets

(56) References Cited

U.S. PATENT DOCUMENTS

| | | | | |
|---|---|---|---|---|
| 5,186,250 | A * | 2/1993 | Ouchi et al. | 165/177 |
| 5,560,425 | A * | 10/1996 | Sugawara et al. | 165/148 |
| 6,321,835 | B1 | 11/2001 | Damsohn et al. | |
| 6,371,201 | B1 * | 4/2002 | Evans et al. | 165/177 |
| 6,799,630 | B1 * | 10/2004 | Kato et al. | 165/177 |
| 6,920,918 | B2 | 7/2005 | Knecht et al. | |
| 6,938,685 | B2 * | 9/2005 | Duerr et al. | 165/148 |
| 2003/0000687 | A1 | 1/2003 | Mathur et al. | |
| 2004/0182556 | A1 * | 9/2004 | Jahn et al. | 165/177 |
| 2006/0048759 | A1 | 3/2006 | Hendrix et al. | |
| 2010/0162699 | A1 | 7/2010 | Dittmann et al. | |
| 2012/0312517 | A1 * | 12/2012 | Natali | 165/177 |

* cited by examiner 1
2
3
4
5
6
7
8
9
10
11
12
13
14
15
17
18
19
20
21
22
23
24
25
26
II
III
IV

EXHAUST GAS COOLER

CROSS-REFERENCES TO RELATED APPLICATIONS

This application claims priority to German patent application DE 10 2008 064 090.5 filed on Dec. 19, 2008, which is hereby incorporated by reference in its entirety.

The present invention relates to an exhaust gas cooler, in particular for an exhaust gas recirculation system of an internal combustion engine, preferably a motor vehicle, with the features of the preamble of claim 1.

U.S. Pat. No. 6,920,918 B2 discloses an exhaust gas cooler comprising an exhaust gas inlet which is connected in a communicating manner with an inlet chamber, an exhaust gas outlet which is connected in a communicating manner with an outlet chamber, a plurality of exhaust gas pipes which are configured as flat pipes, extend parallel to each other through a coolant chamber and are connected in a communicating manner on one side to the inlet chamber and on the other side to the outlet chamber, a coolant inlet which is connected in a communicating manner to the coolant chamber, and a coolant outlet which is connected in a communicating manner to the coolant chamber. The exhaust gas pipes furthermore have on mutually opposite sides a plurality of outwardly projecting protrusions which are spaced apart from each other in the longitudinal direction of the exhaust gas pipes. Adjacent exhaust gas pipes are supported directly against each other by means of these protrusions.

In the known exhaust gas cooler, the protrusions are arranged in such a manner that the protrusions of the respective exhaust gas pipe are supported against the protrusions of the respective adjacent exhaust gas pipe. This means that the heights of the individual protrusions are added up to form a comparatively large distance between adjacent exhaust gas pipes. This means that a coolant path which can be flowed through is produced between adjacent exhaust gas pipes. Furthermore, in the known exhaust gas cooler the individual protrusions are in each case arranged along straight lines which run at an angle of approximately 45° compared to the longitudinal direction of the exhaust gas pipes. A particular advantage of the known design is the possibility of omitting additional fins which can be arranged between adjacent exhaust gas pipes in order to improve the heat transfer between the coolant and the exhaust gas pipes.

U.S. Pat. Nos. 6,453,988 B1, 6,453,989 B1 and 6,892,806 B2 disclose further exhaust gas coolers in which fins are however arranged between adjacent exhaust gas pipes in order to improve the heat transfer between the coolant and the exhaust gas pipes.

The present invention is concerned with the problem of specifying an improved embodiment for an exhaust gas cooler of the type mentioned at the start, which is characterised in particular by effective cooling power with an extremely compact design. Moreover, it should be possible to realise the exhaust gas cooler in a comparatively inexpensive manner.

This problem is solved according to the invention by the subject matter of the independent claims. Advantageous embodiments form the subject matter of the dependent claims.

The invention is based according to a first solution on the general idea of arranging the protrusions which are formed on the sides of the exhaust gas pipes which face away from each other in such a manner that the protrusions of one exhaust gas pipe in each case bear against the other exhaust gas pipe between two protrusions of this other exhaust gas pipe when in the assembled state. It is clear that this cannot apply to all the protrusions of the respective exhaust gas pipe, as at least the outer protrusions, that is, those which are arranged in the region of the longitudinal ends of the respective exhaust gas pipe, only have one adjacent protrusion on the respectively adjacent exhaust gas pipe. The proposed design means that the distance between adjacent exhaust gas pipes is reduced to the height of the protrusions, that is, to the amount by which the protrusions project from the respective side of the associated exhaust gas pipe. This means that the cross section which can be flowed through of the coolant path which is formed between adjacent exhaust gas pipes can be reduced, which increases the flow speed and thus improves heat transfer between the coolant and the exhaust gas pipe. Furthermore, with this design as before, fins between the adjacent exhaust gas pipes can be dispensed with, which allows an inexpensive realisation of the exhaust gas cooler.

According to an advantageous embodiment, the individual protrusions on the respective side of the respective exhaust gas pipe can be adjacent to each other along a straight line which extends parallel to the longitudinal direction of the respective exhaust gas pipe. This means that a geometry results which is comparatively simple to produce. Moreover, a comparatively large surface area can be provided for the heat transfer.

According to another embodiment, the protrusions can have in each case a straight-edged shape, with a longitudinal direction of these straight-edged protrusions running at an angle with respect to the longitudinal direction of the respective exhaust gas pipe. This means that the protrusions are given a flow-directing function, which conducts the coolant in the longitudinal direction of the protrusions through the coolant path which is formed between adjacent exhaust gas pipes. For example, the counterflow principle can be facilitated by this in the flow through the exhaust gas cooler.

Alternatively, protrusions are also conceivable which are formed in a circular manner in a projection which is oriented perpendicularly to the plane of the respective exhaust gas pipe.

Particularly advantageous is an embodiment in which the exhaust gas pipes on mutually opposite sides have a plurality of depressions which project inwardly and are at a distance from each other in the longitudinal direction of the exhaust pipes, in addition to the protrusions. These depressions are arranged in each case between the protrusions. A reversed arrangement is likewise possible, so that the protrusions are in each case arranged between the depressions. The depressions and the protrusions generally alternate in the longitudinal direction of the exhaust gas pipes. These protrusions enlarge the surface area in the interior of the exhaust gas pipes, which improves heat transfer between the exhaust gas pipe and the exhaust gas flow. Furthermore, the cross section which can be flowed through of the exhaust gas pipes is thereby reduced, which increases the flow speed of the exhaust gas. This also results in improved heat transfer between the exhaust gas and the exhaust gas pipe. It is also possible to force a manifold or multiple diversion of the flow using the depressions in the interior of the exhaust gas pipes, which likewise improves the heat transfer between the exhaust gas and the exhaust gas pipe.

In a particularly advantageous embodiment, the protrusions of one exhaust gas pipe can bear against the other exhaust gas pipe in the region of the depressions of the other exhaust gas pipe in such a manner that in each case a coolant path is produced which can be flowed through transversely with respect to the longitudinal direction of the exhaust gas pipes, communicates at its ends with the coolant chamber and is delimited between its ends by the respective depression on one side and by the respective protrusion on the other. This design means that additional surface area is also created in the coolant chamber, which surface area is in contact with the coolant and improves heat transfer between the exhaust gas pipe and the coolant. A diversion in the flow also takes place, which likewise facilitates heat transfer between the exhaust gas pipe and the coolant.

According to a second solution, the present invention is based on the general idea of bringing into contact adjacent exhaust gas pipes over an area directly on the sides which face each other, with depressions which project inwardly being introduced into these sides in such a manner that they form at least one coolant path which can be flowed through transversely with respect to the longitudinal direction of the exhaust gas pipes and communicates with the coolant chamber. In this configuration the exhaust gas cooler has an extremely compact structure. The depressions mean that sufficient surface area is created to realise the heat transfer between the exhaust gas pipe and the coolant. This embodiment also manages without fins between adjacent exhaust gas pipes and has a correspondingly inexpensive structure.

According to an advantageous embodiment, the depressions which are made in the mutually opposite sides of the exhaust gas pipes can be arranged adjacent to each other transversely with respect to the longitudinal direction of the respective exhaust gas pipe. For the coolant path which is formed between adjacent exhaust gas pipes, this means that it contains a plurality of diversions in flow or changes in direction. This means that the heat transfer between the coolant and the exhaust gas pipes is improved.

An embodiment is advantageous in which the depressions extend in each case continuously from a longitudinal end region of the respective exhaust gas pipe as far as the other longitudinal end region of the respective exhaust gas pipe. This shape facilitates a transverse exchange of coolant, which can likewise be used advantageously for the heat transfer between the exhaust gas pipes and the coolant.

Further important features and advantages of the invention can be found in the subclaims, the drawings and the associated description of the figures using the drawings.

It is self-evident that the features which are mentioned above and those which are still to be explained below can be used not only in the combination specified in each case, but also in other combinations or alone without departing from the framework of the present invention.

Preferred exemplary embodiments of the invention are shown in the drawings and are explained in more detail in the following description, with the same reference symbols referring to the same or similar or functionally identical components.

Figure 4:
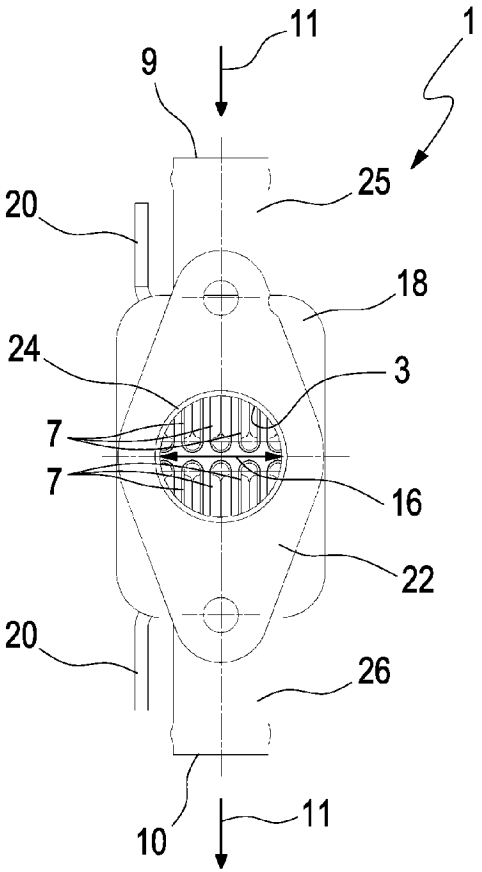
Figure 3:
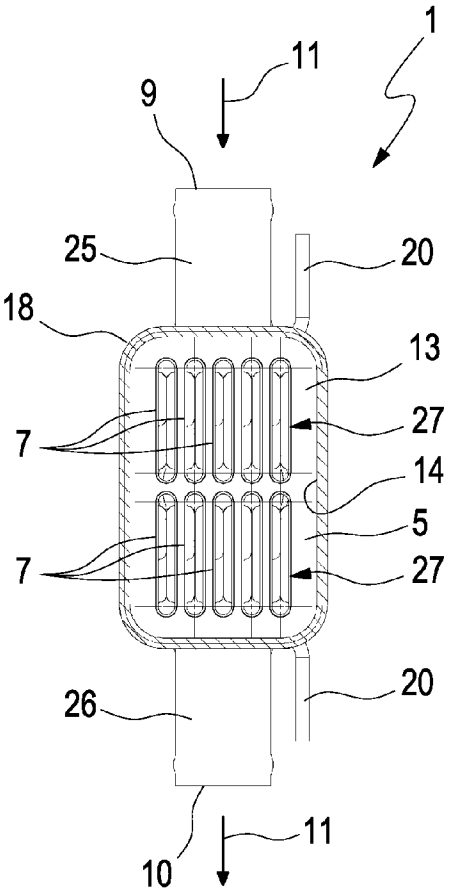
Figure 5:
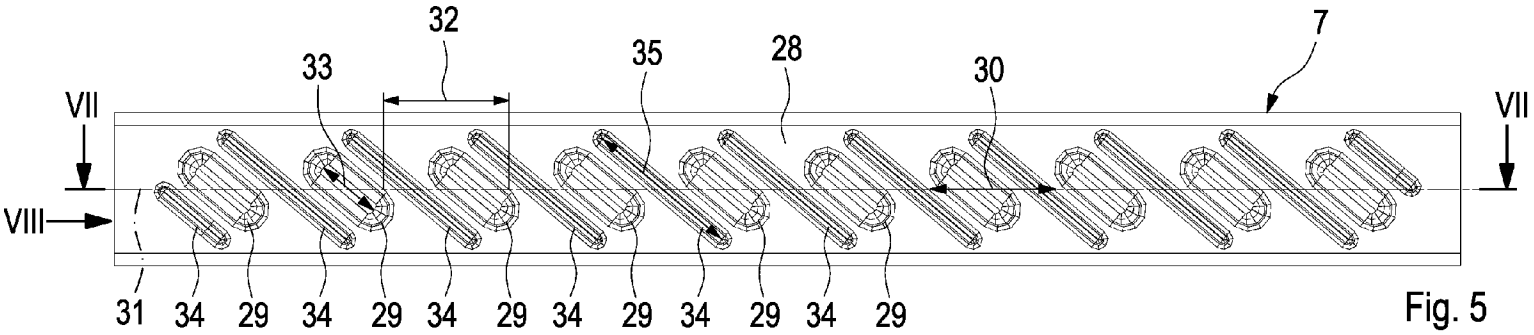
Figure 6:
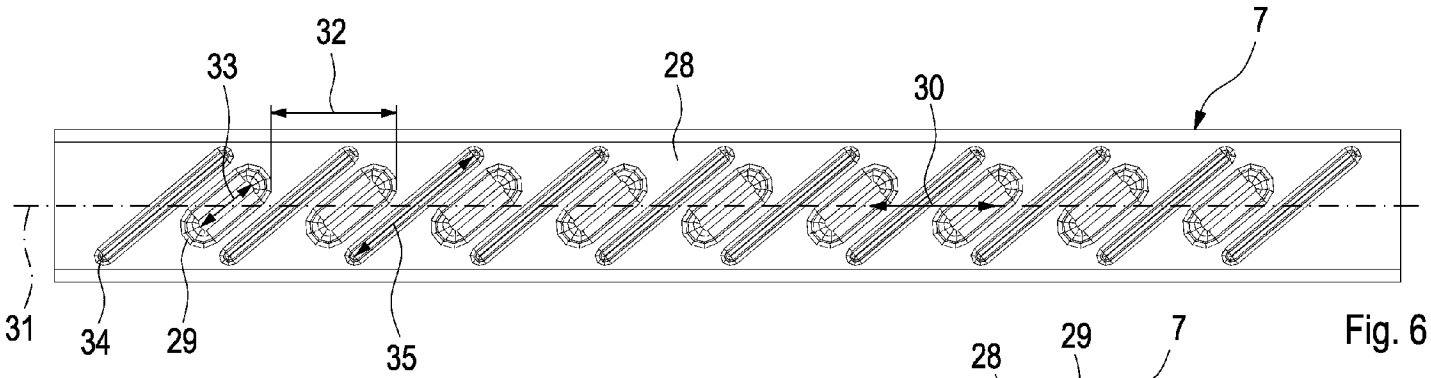
Figure 8:
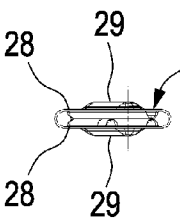
Figure 7:
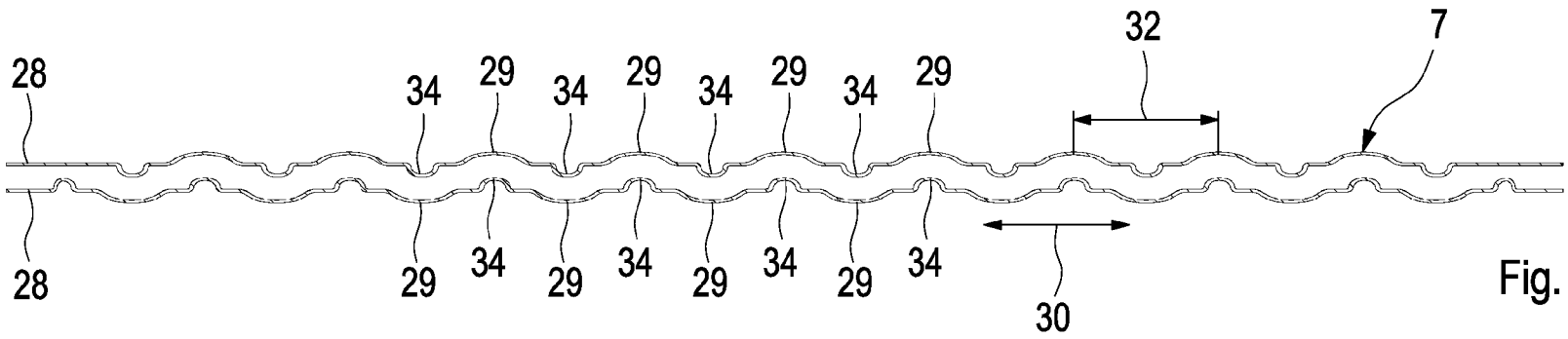
Figure 12:
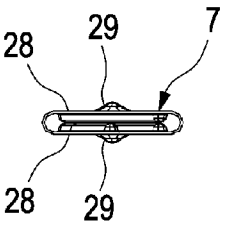
Figure 13:
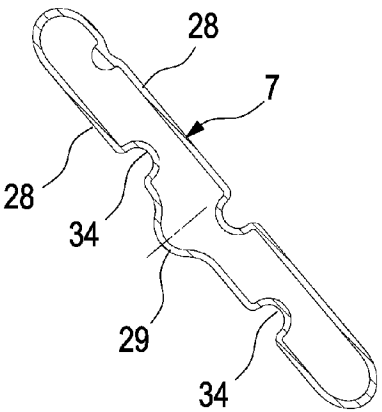
Figure 9:
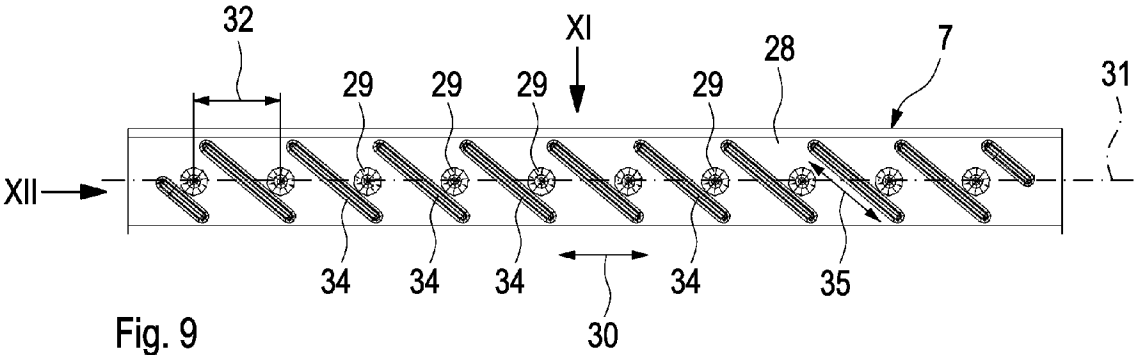
Figure 10:
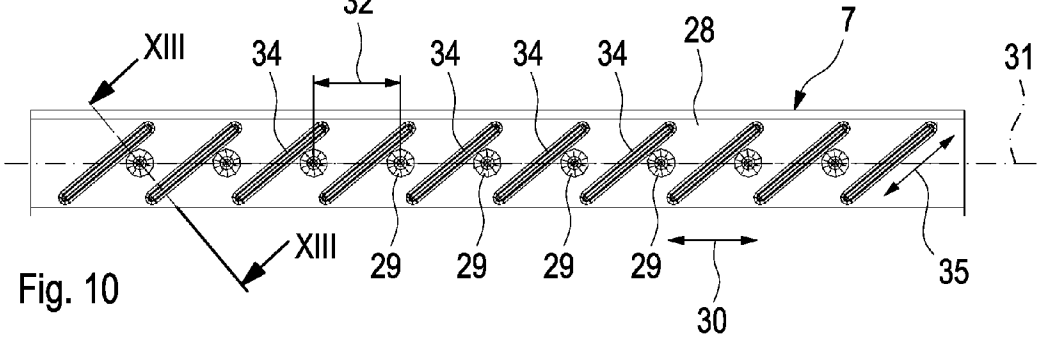
Figure 11:
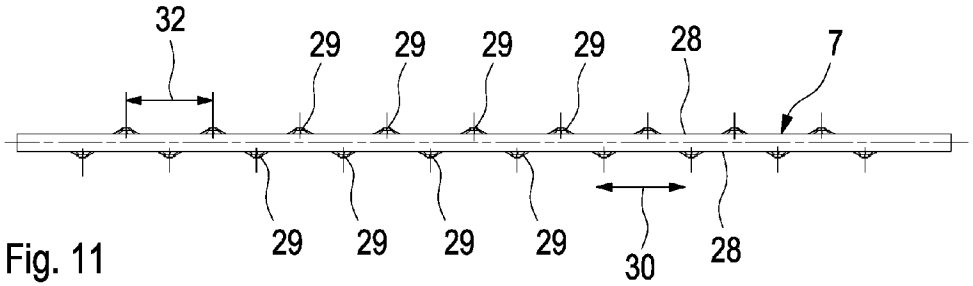
Figure 14:
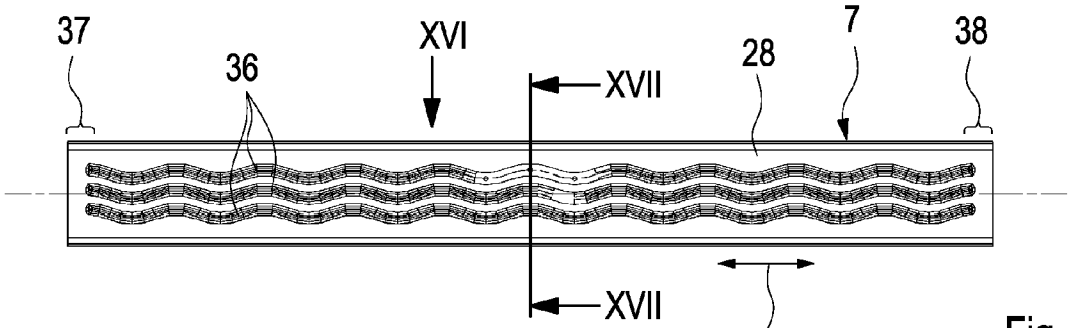
Figure 16:
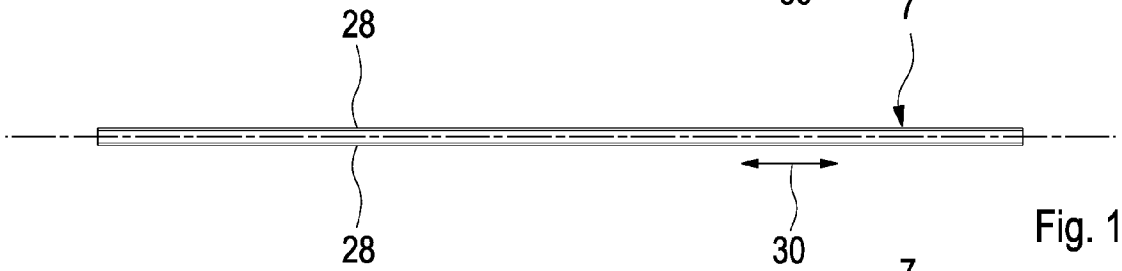
Figure 15:
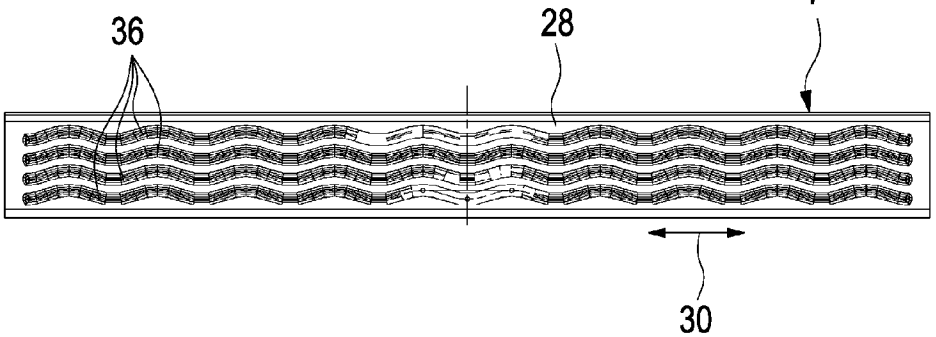
Figure 17:
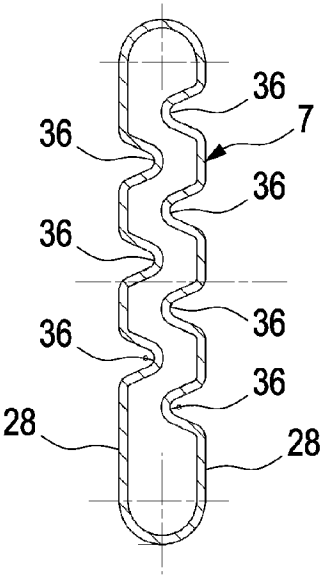

In the figures,

FIG. 1 schematically shows a side view of an exhaust gas cooler,

FIG. 2 schematically shows a longitudinal section of the exhaust gas cooler corresponding to section lines II in FIG. 1, FIG. 3 schematically shows a cross section of the exhaust gas cooler corresponding to section lines III in FIG. 1, FIG. 4 schematically shows a front view of the exhaust gas cooler corresponding to a viewing direction IV in FIG. 1, FIG. 5 schematically shows a view from above of an exhaust gas pipe, FIG. 6 schematically shows a view from below of an exhaust gas pipe, FIG. 7 schematically shows a longitudinal section of the exhaust gas pipe corresponding to section lines VII in FIG. 5, FIG. 8 schematically shows a front view of the exhaust gas pipe corresponding to a viewing direction VIII in FIG. 5, FIG. 9 schematically shows a view from above of an exhaust gas pipe in a different embodiment, FIG. 10 schematically shows a view from below of the exhaust gas pipe of FIG. 9, FIG. 11 schematically shows a side view of the exhaust gas pipe corresponding to a viewing direction XI in FIG. 9, FIG. 12 schematically shows an end view of the exhaust gas pipe corresponding to a viewing direction XII in FIG. 9, FIG. 13 schematically shows a sectional view of the exhaust gas pipe corresponding to section lines XIII in FIG. 10, FIG. 14 schematically shows a view from above of an exhaust gas pipe in a further embodiment, FIG. 15 schematically shows a view from below of the exhaust gas pipe of FIG. 14, FIG. 16 schematically shows a side view of the exhaust gas pipe corresponding to a viewing direction XVI in FIG. 14, FIG. 17 schematically shows a sectional view of the exhaust gas pipe corresponding to section lines XVII in FIG. 14.

According to FIG. 1-4, an exhaust gas cooler 1, which is preferably an exhaust gas recirculating cooler, comprises an exhaust gas inlet 2 and an exhaust gas outlet 3. The exhaust gas inlet 2 communicates with an inlet chamber 4, whereas the exhaust gas outlet 3 communicates with an outlet chamber 5. An exhaust gas flow 6 which leads to the exhaust gas cooler 1 and away from the exhaust gas cooler 1 is indicated by arrows. The exhaust gas cooler 1 can preferably be used in an exhaust gas recirculation system of an internal combustion engine in order to cool recirculated exhaust gases. The internal combustion engine is preferably arranged in a motor vehicle.

The exhaust gas cooler 1 has a plurality of exhaust gas pipes 7. These are configured as flat pipes in accordance with FIG. 3-17. This means that the exhaust gas pipes 7 are much wider than they are high in cross section. For example, they are at least five times or at least ten times wider than they are high. The exhaust gas pipes 7 are expediently configured as identical components. The exhaust gas pipes 7 extend parallel to each other and extend through a coolant chamber 8 of the exhaust gas cooler 1. The exhaust gas pipes 7 are connected in a communicating manner to the inlet chamber 4 on one side and to the outlet chamber 5 on the other. Furthermore, the exhaust gas cooler 1 has a coolant inlet 9 which is connected to the coolant chamber 8 and a coolant outlet 10 which is likewise connected in a communicating manner to the coolant chamber 8. A coolant flow 11 is indicated symbolically in FIG. 1 by arrows. The exhaust gas cooler 1 is preferably included in the exhaust gas flow 6 and in the coolant flow 11 in such a manner that a through-flow forms in the counter flow.

According to FIG. 2 the exhaust gas pipes 7 penetrate a wall 12 on the inlet side and a wall 13 on the outlet side. The exhaust gas pipes 7 are fixed to these walls 12, 13 in a gastight manner. The wall 12 on the inlet side separates the coolant chamber 8 from the inlet chamber 4. The wall 13 on the outlet side separates the coolant chamber 8 from the outlet chamber 5. The coolant chamber 8 is surrounded by a housing 14. A cross section 15 of the housing 14 is larger than a cross section 16 of the exhaust gas outlet 3, which can be seen in FIG. 4. It is also larger than a cross section of the exhaust gas inlet 2, which cannot be seen here. The cross section of the exhaust gas inlet 2 is expediently the same size as the cross section 16 of the exhaust gas outlet 3. According to FIGS. 1 and 2, the inlet chamber 4 is surrounded by an inlet funnel 17, whereas the outlet chamber 5 is surrounded by an outlet funnel 18. Whereas the inlet funnel 17 connects the exhaust gas inlet 2 to the housing 14, the outlet funnel 18 creates a connection between the housing 14 and the exhaust gas outlet 3. At least one of the funnels 17, 18 is placed onto the housing 14 from the outside. In the example both funnels 17, 18 are placed onto the housing 14 from the outside. This means that an axial overlap region 19 is created, which is indicated in FIG. 2 by a curly bracket. The respective wall 12 or 13 is also arranged in this overlap region 19. It can be seen that the respective wall 12, 13 butts at the edges against an inner side (not shown in detail) of the housing 14 and is connected edge to edge to the housing 14.

In the example two fastening lugs 20 are fixed to the housing 14, with the aid of which the exhaust gas cooler 1 can be fixed to a corresponding support or the like. The exhaust gas cooler 1 furthermore has an inlet flange 21 and an outlet flange 22, with the aid of which the exhaust gas cooler 1 can be included in an exhaust gas recirculation line. The exhaust gas inlet 2 is arranged in the inlet flange 21. To this end, an inlet pipe 23 is provided which has the exhaust gas inlet 2 and which projects into the inlet flange 21 on one side and projects into the inlet funnel 17 on the other side. An outlet pipe 24 is provided on the outlet side, which projects into the outlet funnel 18 on one side and projects into the outlet flange 22 on the other side. This outlet pipe 24 furthermore has the exhaust gas outlet 3. The coolant inlet 9 is also formed on an inlet connecting piece 25 which is connected in a suitable manner to the housing 14. An outlet connecting piece 26 is also provided, which has the coolant outlet 10 and is connected in a suitable manner to the housing 14.

The exhaust gas cooler 1 is preferably produced completely from stainless steel. At least one of the following components is however produced from stainless steel: inlet flange 21, inlet pipe 23, inlet funnel 17, inlet-side wall 12, housing 14, outlet-side wall 13, outlet funnel 18, outlet pipe 24, outlet flange 22, exhaust gas pipe 7, inlet connecting piece 25, outlet connecting piece 26, fastening lug 20. The components of the exhaust gas cooler 1 which have been produced separately are preferably fixed to each other by means of welded connections.

According to FIG. 3, at least two adjacently arranged stacks 27 can be arranged in the coolant chamber 8, which stacks comprise in each case a plurality of exhaust gas pipes 7 which are stacked on top of each other.

According to FIG. 5-17, the exhaust gas pipes 7 have in each case a plurality of outwardly projecting protrusions 29 on mutually opposite sides 28 which are the wider sides of the flat exhaust gas pipes 7. These are arranged at a distance from each other in a longitudinal direction 30 of the exhaust gas pipes 7. Such protrusions 29 are present in the embodiments of FIG. 5-13, whereas they are not present in the embodiment of FIG. 14-17. Adjacent exhaust gas pipes 7 are supported directly against each other by means of these protrusions 29 in the embodiments of FIG. 5-13. In the embodiments of FIG. 5-13 presented here, these protrusions 29 are arranged and configured in such a manner that, in the exhaust gas pipes 7 which bear against each other, the protrusions 29 of one exhaust gas pipe 7—except for the first protrusion 29 and the last protrusion 29 in each case—bear directly against the other exhaust gas pipe 7 in each case between two adjacent protrusions 29 of this other exhaust gas pipe 7. In other words, all the protrusions 29 of one exhaust gas pipe 7 bear in each case directly against the other exhaust gas pipe 7 at a distance in the longitudinal direction 30 from the nearest protrusion 29 of this other exhaust gas pipe 7. This means that the distance between adjacent exhaust gas pipes 7 corresponds to the height of the protrusions 29.

In the embodiments of FIG. 5-13, the individual protrusions 29 are arranged on the respective side 28 of the associated exhaust gas pipe 7 along a straight line 31 which extends parallel to the longitudinal direction 30 of the associated exhaust gas pipe 7.

As can be seen in particular in sectional views of FIGS. 7 and 11, the protrusions 29 can be arranged offset with respect to each other in the longitudinal direction 30 on the sides 28 which face away from each other within the respective exhaust gas pipe 7. The offset which is made in the longitudinal direction 30 is expediently such that it corresponds to half of a distance 32 measured in the longitudinal direction 30 between two adjacent protrusions 29. This means that on the respective exhaust gas pipe 7 the protrusions 29 of one side are arranged in each case, in particular centrally, between two adjacent protrusions 29 of the other side 28 of this exhaust gas pipe 7 with respect to a projection which is oriented perpendicularly to the plane of the respective exhaust gas pipe 7.

In the example of FIG. 5-8 the protrusions 29 have in each case a straight-edged shape. A longitudinal direction 33 of these straight-edges protrusions 29 is aligned at an angle to the longitudinal direction 30 of the associated exhaust gas pipe 7. In the example the longitudinal direction 33 of the respective straight-edged protrusion 29 is at an angle of approximately 45° to the longitudinal direction 30. In principle, however, other angles are also conceivable. The angle enclosed between the said longitudinal directions 33 and 30 is preferably in a range from 40° to 50° inclusive. All the straight-edged protrusions 29 are expediently oriented parallel to each other on the respective side 28 of the associated exhaust gas pipe 7. The straight-edged protrusions 29 on the respective exhaust gas pipe 7 are expediently inclined compared to the longitudinal direction 30 of the associated exhaust gas pipe 7 in the same direction and in particular parallel to each other on the two mutually opposite sides 28, in particular in a projection which is oriented perpendicularly to the plane of the respective exhaust gas pipe 7.

FIG. 9-13 show a different embodiment and a different shape for the protrusions 29. In this case they have a circular configuration in a projection which is oriented perpendicularly to the plane of the respective exhaust gas pipe 7. The protrusions 29 thereby have a stud-like configuration. In the preferred embodiment shown here they are arranged in each case centrally on the respective side 28 with respect to the wide direction of the respective exhaust gas pipe 7.

In the embodiments of FIG. 5-13, the exhaust gas pipes 7 also have a plurality of inwardly projecting depressions 34 on the mutually opposite sides 28. These are also spaced apart from each other in the longitudinal direction 30 of the associated exhaust gas pipe 7. The arrangement shown in the embodiments of FIG. 5-13, in which depressions 34 and protrusions 29 alternate in the longitudinal direction 30, is expedient. One protrusion 29 is arranged in each case between two adjacent depressions 34. The depressions 34 and the protrusions 29 are expediently positioned in such a manner that the protrusions 29 of one exhaust gas pipe 7 in each case bear against the other exhaust gas pipe 7 in the region of at least one such depression 34 of the adjacent other exhaust gas pipe 7.

In the embodiments shown, the depressions 34 are in each case formed with straight edges. They have a longitudinal direction 35 which runs likewise in inclined manner to the longitudinal direction 30 of the associated exhaust gas pipe 7. It is expedient that all the depressions 34 of the respective exhaust gas pipe 7 extend parallel to each other. The angle enclosed by the longitudinal direction 35 of the depressions and the longitudinal direction 30 of the associated exhaust gas pipe 7 is expediently between 40° and 50° inclusive. The said angle is 45° in the example shown. The longitudinal direction 33 of the protrusions 29 thus extends parallel to the longitudinal direction 35 of the depressions 34 in the examples shown. It is also provided here for the depressions 34 to run in an inclined manner to the longitudinal direction 30 of the exhaust gas pipe 7 in the same direction on the two mutually opposite sides 28 of the same exhaust gas pipe 7, as a result of which a parallel arrangement of the straight-edged depressions 34 and the straight-edged protrusions 29 is produced in the projection perpendicular to the plane of the respective exhaust gas pipe 7.

In the embodiments of FIG. 5-13 shown here, the depressions 34 are narrower or shorter than the protrusions 29 in the longitudinal direction 30 of the associated exhaust gas pipe 7. Furthermore, the depressions 34 are larger or longer than the protrusions 29 transversely to the longitudinal direction 30 of the associated exhaust gas pipe 7. According to FIG. 8, the depressions 34 can expediently project so far into the interior of the respective exhaust gas pipe 7 that the depressions 34 of the mutually opposite sides 28 bear against each other in the interior of the exhaust gas pipe 7. The depressions 34 thus project in each case into the exhaust gas pipe 7 with a depth or height which corresponds to half the distance of the mutually opposite sides 28 of the exhaust gas pipe 7.

In the embodiments of FIG. 5-13 shown here, the depressions 34 and the protrusions 29 are matched to each other in such a manner that the protrusions 29 of one exhaust gas pipe 7 bear against the adjacent or other exhaust gas pipe 7 in each case in the region of the depressions 34 of the other exhaust gas pipe 7, in such a manner that a coolant path is produced thereby which can be flowed through transversely to the longitudinal direction 30 of the exhaust gas pipes 7. The respective coolant path is connected at its ends in a communicating manner to the coolant chamber 8, as the protrusions 29 cannot cover the depression 34 opposite completely. The respective coolant path is then delimited between its ends by the respective depression 34 or its walls on one side and by the respective protrusion 29 or its walls on the other side. The flow passes in a targeted manner through the depressions 34 and around the protrusions 29 with the aid of these coolant paths. In this manner more surface area can come into contact with the coolant, which improves the heat transfer between the exhaust gas pipes 7 and the coolant.

In the embodiment shown in FIG. 14-17, the exhaust gas pipes 7 have in each case a plurality of inwardly projecting depressions 36 on the mutually opposite sides 28. In this embodiment there are however no protrusions 29 present. As a consequence, adjacent exhaust gas pipes 7 can bear directly and areally against each other on the sides 28 which contain the depressions 36 and preferably be flat. The depressions 36 are however configured and arranged in such a manner that they form at least one coolant path on the sides 28 which bear against each other or between exhaust gas pipes 7 which bear against each other, which coolant path can be flowed through transversely to the longitudinal direction 30 of the exhaust gas pipes 7. This coolant path also communicates with the coolant chamber 8.

In contrast to the embodiments of FIG. 5-13, the depressions 36 are arranged adjacent to each other and at a distance from each other not in the longitudinal direction 30 of the exhaust gas pipes 7, but transversely with respect to the longitudinal direction 30 of the exhaust gas pipes 7. As can be seen clearly in FIGS. 14 and 15, the depressions 36 in each case have a continuous configuration so that they extend from an inlet-side longitudinal end region 37 of the respective exhaust gas pipe 7 to an outlet-side longitudinal end region 38 of the respective exhaust gas pipe 7. This means that a transverse exchange of coolant can take place over the entire length of the exhaust gas pipes 7. In the example the depressions 36 have a wave-like or snake-like configuration with respect to their longitudinal direction. Other shapes, such as a sawtooth shape, are also conceivable.

The depressions 36 are arranged or shaped in such a manner that the depressions 36 of the sides 38 which bear against each other of adjacent exhaust gas pipes 7 intersect repeatedly along the longitudinal direction 30 of the exhaust gas pipes 7. This means that coolant can pass from the depressions 36 of one exhaust gas pipe 7 into the depressions of the other, adjacent exhaust gas pipe 7 which bears against it. This improves mixing and thus heat transfer. This is achieved for example by the depressions 36 inside the respective exhaust gas pipe 7 being shaped and arranged in such a manner that the depressions 36 of the mutually opposite sides 28 intersect repeatedly along their longitudinal direction or along the longitudinal direction 30 of the exhaust gas pipe 7 in the interior of the respective exhaust gas pipe 7. A projection is observed in this case which is oriented perpendicularly to the plane of the respective exhaust gas pipe 7. If for example the wave-shaped depressions 36 on the upper side 28 according to FIG. 14 and on the lower side 28 according to FIG. 15 are considered, it can be seen that the wave peaks of the upper side 28 meet the wave troughs of the lower side 28 and vice versa. This leads to the said intersections in the profile of the respective depressions 36.

According to FIG. 17, in a preferred embodiment the depressions 36 on the mutually opposite sides 28 of the respective exhaust gas pipe 7 project so far into the interior of the respective exhaust gas pipe 7 that they touch each other in the interior of the exhaust gas pipe 7. A symmetrical arrangement is expedient here, so that the depressions 36 of the respective side 28 cover in each case approximately half of the distance between the sides 28. The depressions 36 preferably bear areally against each other.

In the example, without loss of generality, three depressions 36 are provided on one side 28 according to FIG. 14, whereas four such depressions 36 are provided on the opposite side 28 according to FIG. 15. As one more depression 36 is arranged on one side 28 than on the other side 28, it is particularly simple to place adjacent exhaust gas pipes 7 against each other in such a manner that the desired intersections and the desired coolant paths are produced.

The invention claimed is:

1. An exhaust gas recirculation system cooler, comprising:

an exhaust gas inlet connected to and in fluid communication with an inlet chamber;

an exhaust gas outlet connected to and in fluid communication with an outlet chamber;

a plurality of generally flat exhaust gas pipes extend parallel to each other through a coolant chamber and are in fluid communication with the inlet chamber on one side and to the outlet chamber on an opposite side;

a coolant inlet connected to and in fluid communication with the coolant chamber; and a coolant outlet connected to and in fluid communication with the coolant chamber, wherein the exhaust gas pipes include a plurality of outwardly projecting protrusions spaced apart from each other in a longitudinal direction of the exhaust gas pipes, wherein the protrusions of one exhaust gas pipe bear directly against an adjacent exhaust gas pipe at a distance in the longitudinal direction of the exhaust gas pipes from the nearest protrusion of the other exhaust gas pipe;

wherein the exhaust gas pipes have a plurality of inwardly projecting depressions on opposite sides, such that the depressions are at a distance from each other in the longitudinal direction of the exhaust gas pipes;

wherein the protrusions of one exhaust gas pipe bear against the other exhaust gas pipe in a region of at least one depression of the other exhaust gas pipe.

2. An exhaust gas recirculation system cooler according to claim 1, such that the protrusions on the side of the exhaust gas pipe are adjacent to each other along a straight line extending parallel in the longitudinal direction of the exhaust gas pipe.

3. An exhaust gas recirculation system cooler according to claim 1, wherein the exhaust gas pipe protrusions on one side are arranged offset to the protrusions of the other side, by half of the longitudinal distance of the adjacent protrusions, in the longitudinal direction of the exhaust gas pipe.

4. An exhaust gas recirculation system cooler according to claim 1, such that the protrusions have a straight-edged shape, wherein a longitudinal direction of the straight-edged protrusions runs in an inclined manner to the longitudinal direction of the respective exhaust gas pipe.

5. An exhaust gas recirculation system cooler according to claim 4, wherein the straight-edged protrusions extend parallel to each other, and the longitudinal direction of the protrusion is at least one of inclined at an approximate range between 40° and 50° inclusive and by approximately 45° to the longitudinal direction of the exhaust gas pipe; and the longitudinal direction of the protrusions on one side of the exhaust gas pipe is oriented parallel to the longitudinal direction of the protrusions on the other side of the respective exhaust gas pipe.

6. An exhaust gas recirculation system cooler according to claim 1, wherein the protrusions have a generally circular configuration in a projection which is oriented perpendicularly to a plane of the exhaust gas pipe.

7. An exhaust gas recirculation system cooler according to claim 1, wherein the depressions have a straight-edged shape, such that a longitudinal direction of the straight-edged depressions run in an inclined manner in the longitudinal direction of the exhaust gas pipe.

8. An exhaust gas recirculation system cooler according to claim 7, wherein the straight-edged depressions extend parallel to each other, and the longitudinal direction of the respective depression is at least one of inclined at an approximate range between 40° and 50° inclusive and by approximately 45° to the longitudinal direction of the respective exhaust gas pipe, and the longitudinal direction of the straight-edged depressions extends parallel to the longitudinal direction of the straight-edged protrusions, and the longitudinal direction of the depressions on one side of the exhaust gas pipe is oriented parallel to the longitudinal direction of the depressions on the other side of the exhaust gas pipe.

9. An exhaust gas recirculation system cooler according to claim 1, wherein the depressions are narrower than the protrusions in the longitudinal direction of the exhaust gas pipe, and the depressions are longer than the protrusions transversely to the longitudinal direction of the exhaust gas pipe.

10. An exhaust gas recirculation system cooler according to claim 1, wherein with at least two adjacent exhaust gas pipes, the protrusions of one exhaust gas pipe selectively bear against the other exhaust gas pipe in the region of the depressions of the other exhaust gas pipe such that a coolant path is produced which can be flowed through transversely with respect to the longitudinal direction of the exhaust gas pipes, and the coolant path communicates at its ends with the coolant chamber and is delimited between its ends by the depression on one side and by the protrusion on the other.

11. An exhaust gas recirculation system cooler according to claim 1, wherein the depressions on the mutually opposite sides of the exhaust gas pipe project and bear against each other in an interior of the exhaust gas pipe.

12. An exhaust gas recirculation system cooler according to claim 1, wherein at least two stacks of exhaust gas pipes are at least one of stacked on top of each other, bear against each other and are arranged next to each other in the coolant chamber.

13. An exhaust gas recirculation system cooler according to claim 1, wherein the exhaust gas pipes penetrate a wall on at least one of the inlet and outlet side and the exhaust gas pipes are fixedly connected to the wall, and the wall separates the coolant chamber from at least one of the inlet chamber and from the outlet chamber.

14. An exhaust gas recirculation system cooler according to claim 13, wherein the wall abuts an edge against an inner side of the housing and is connected edge to edge to the housing.

15. An exhaust gas recirculation system cooler according to claim 1, wherein the coolant chamber is surrounded by a housing, such that a housing cross section is larger than a cross section of the exhaust gas outlet and is larger than a cross section of the exhaust gas inlet.

16. An exhaust gas recirculation system cooler according to claim 15, wherein the inlet chamber is surrounded by an inlet funnel, which connects the exhaust gas inlet to the housing.

17. An exhaust gas recirculation system cooler according to claim 16, wherein at least one of the inlet funnel and the outlet funnel is placed onto the housing from the outside.

18. An exhaust gas recirculation system cooler according to claim 17, wherein the wall is arranged in an overlap region of the funnel.

19. An exhaust gas recirculation system cooler according to claim 15, wherein the outlet chamber is surrounded by an outlet funnel which connects the exhaust gas outlet to the housing.

20. An exhaust gas recirculation system cooler according to claim 1, wherein at least one of the: exhaust gas inlet, an inlet pipe which has the exhaust gas inlet, the exhaust gas outlet, an outlet pipe which has the exhaust gas outlet, the coolant inlet an inlet connecting piece which has the coolant inlet, the coolant outlet an outlet connecting piece which has the coolant outlet, the exhaust pipes, housing, an inlet-side wall, outlet-side wall, inlet funnel, outlet funnel, an inlet flange which comprises the exhaust gas inlet, and an outlet flange which comprises the exhaust gas outlet is produced from stainless steel.

21. An exhaust gas recirculation system cooler according to claim 1, wherein at least one of the components fixed to the exhaust gas cooler and at least two components fixed to the exhaust gas cooler are fixed to each other by a welded connection.

22. An exhaust gas recirculation system cooler according to claim 1, wherein the protrusions are at least one of (i) a straight-edged shape and (ii) having a circular configuration.

* * * * *